United States Patent [19]

Tan

[11] 4,263,245

[45] Apr. 21, 1981

[54] PROCESS FOR PRODUCING HIGH-STRENGTH, ULTRALOW DENIER POLYBENZIMIDAZOLE (PBI) FILAMENTS

[75] Inventor: Marshall Tan, Ridgefield Park, N.J.

[73] Assignee: Celanese Corporation, New York, N.Y.

[21] Appl. No.: 32,422

[22] Filed: Apr. 23, 1979

[51] Int. Cl.[3] ..... D01D 5/12

[52] U.S. Cl. ..... 264/184; 264/203; 264/210.4; 264/210.6; 264/210.7; 264/210.8

[58] Field of Search ..... 264/184, 203, 210.4, 264/210.7, 210.6, 210.8, 289.6, 289.3

[56] References Cited

U.S. PATENT DOCUMENTS

| | | | |
|---|---|---|---|
| 3,079,219 | 2/1963 | King | 264/184 |
| 3,414,645 | 12/1968 | Morgan | 264/184 |
| 3,441,640 | 4/1969 | Santangelo | 264/203 |
| 3,584,104 | 6/1971 | Bohrer et al. | 264/289.6 |
| 3,619,453 | 11/1971 | Riggs | 264/203 |
| 3,642,706 | 2/1972 | Morgan | 264/184 |
| 3,816,581 | 6/1974 | Prince | 264/203 |
| 3,836,621 | 9/1974 | Prince | 264/289.3 |
| 3,851,025 | 11/1974 | Ram | 264/184 |
| 4,020,142 | 4/1977 | Davis et al. | 264/184 |

FOREIGN PATENT DOCUMENTS

| | | | |
|---|---|---|---|
| 50-48217 | 4/1975 | Japan | 264/184 |

*Primary Examiner*—Jay H. Woo

*Attorney, Agent, or Firm*—Kenneth A. Genoni

[57] ABSTRACT

An improved process for the production of ultralow denier, high-strength polybenzimidazole filaments is provided. A solution of the polymer is extruded vertically downward through a plurality of extrusion orifices into a gaseous atmosphere before being passed through a liquid coagulation bath. During their passage from the extrusion orifices to the exit from the coagulation bath, the filaments are drawn at an initial draw ratio of approximately 2:1 to 50:1. After being passed through the coagulaton bath, the filaments are washed, dried, and heat drawn at a heat draw ratio of approximately 1.5:1 to 10:1. The resulting filaments, having a denier per filament of approximately 0.05 to 0.50 and a tenacity of at least 4 grams per denier, are collected.

30 Claims, 1 Drawing Figure

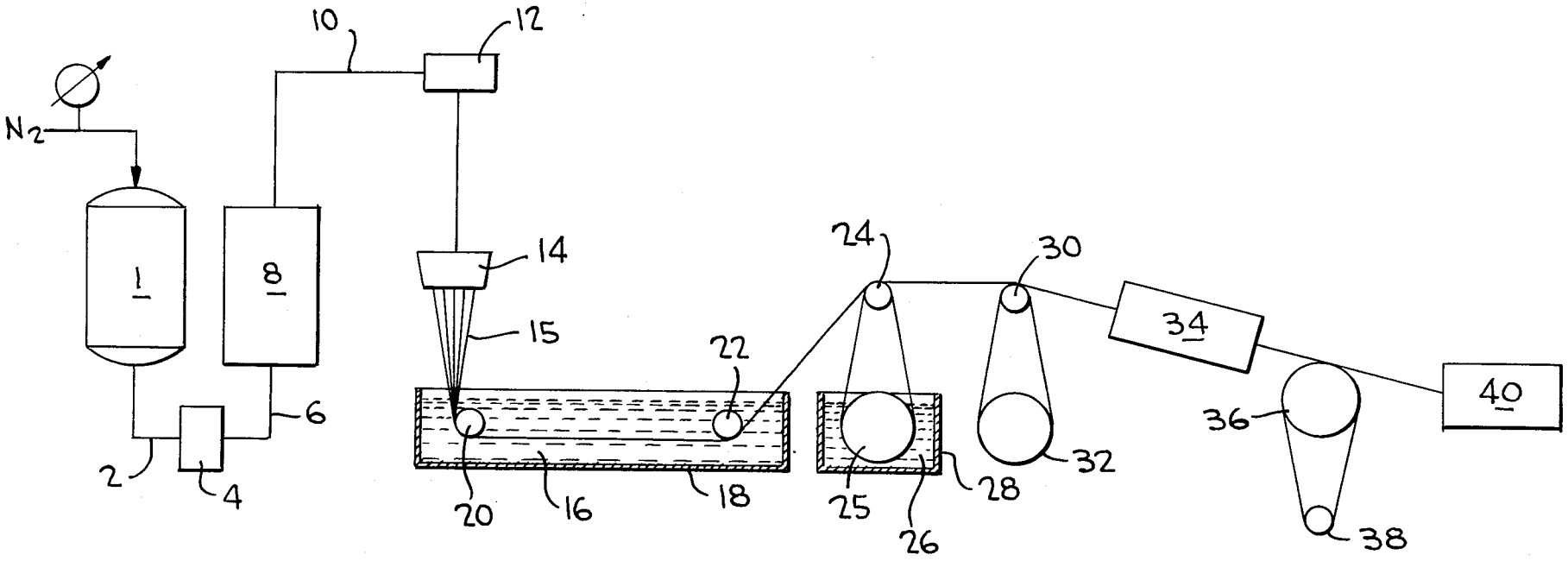
N2
1
2
4
6
8
10
12
14
15
16
18
20
22
24
25
26
28
30
32
34
36
38
40

PROCESS FOR PRODUCING HIGH-STRENGTH, ULTRALOW DENIER POLYBENZIMIDAZOLE (PBI) FILAMENTS

BACKGROUND OF THE INVENTION

Polybenzimidazole is a non-flammable polymer which may be formed into textile fibers characterized by outstanding thermal, physical, and chemical stability. Processing parameters are well established for the extrusion of polybenzimidazole solutions into fibrous materials. Polybenzimidazole fibrous materials heretofore produced for textile applications commonly have exhibited a denier per filament of approximately 1.5.

Commonly assigned U.S. Pat. No. 3,441,640 broadly discloses a wet spinning method for the production of polybenzimidazole filaments having a denier per filament of 0.1 to 50. However, extremely fine filaments are not easily produced on a reliable basis by wet spinning methods. The unavoidable currents formed in the liquid as the polymer is extruded into it can disrupt the filaments. Also, the filaments tend to sag due to the fact that the horizontally extruded material has a higher specific gravity than the liquid of the spin bath.

Dry spinning processes, in which the polymer solution is extruded vertically downward into a hot stream of dry gas, have also been disclosed for the production of polybenzimidazole filaments. However, with superfine filaments, the vertical distances commonly employed in such processes (e.g., 5 to 8 meters) may be a controlling factor since the filaments may not have sufficient strength to maintain integrity all the way to the bottom.

A dry jet/wet spinning process was disclosed in commonly assigned U.S. Pat. No. 3,851,025. That patent relates to the production of hollow polybenzimidazole filaments which are useful for specialized reverse osmosis applications. The patented process does not produce the ultralow denier filaments which are the subject of the present invention.

It is an object of the present invention to provide an improved process for the stable production of high-strength ultralow denier polybenzimidazole filaments.

It is an object of the present invention to provide a commercially practicable on-line, continuous process for the production of ultralow denier polybenzimidazole filaments without diminution of the desired tensile properties.

These and other objects, as well as the scope, nature, and utilization of the process will be apparent from the following description and appended claims.

SUMMARY OF THE INVENTION

It has been found that a process for the stable production of high-strength polybenzimidazole filaments of ultralow denier comprises:

(a) providing a spinning solution comprising approximately 10 to 30 percent by weight of a polybenzimidazole in a solvent selected from the group consisting of dimethylacetamide, dimethylformamide, dimethylsulfoxide, and concentrated sulfuric acid, (b) extruding the spinning solution vertically downward into a gaseous atmosphere following passage through a plurality of extrusion orifices having a diameter of approximately 20 to 200 microns to form a plurality of filaments with the concomitant drawing of the filaments, (c) passing the resulting filaments from the gaseous atmosphere to a bath comprising a non-solvent for the polybenzimidazole, (d) passing the filaments through the bath wherein (i) coagulation of the polybenzimidazole is accomplished, and (ii) the drawing of the filaments is continued, with an initial draw ratio of approximately 2:1 to 50:1 being achieved, (e) passing the filaments from the bath to a washing zone, (f) washing the resulting filaments while passing through the washing zone to substantially remove residual solvent, (g) passing the filaments from the washing zone to a drying zone, (h) drying the filaments while passing through the drying zone, (i) passing the filaments from the drying zone to a drawing zone provided at a temperature of approximately 400° to 500° C., (j) drawing the filaments while passing through the drawing zone at a heat draw ratio of approximately 1.5:1 to 10:1 to produce polybenzimidazole filaments having a denier per filament of approximately 0.05 to 0.50 and a tenacity of at least 4 grams per denier, and (k) collecting the ultralow denier filaments following withdrawal from the drawing zone.

DESCRIPTION OF THE DRAWING

The drawing is a schematic representation of an apparatus arrangement capable of carrying out the process of the present invention. Reference is made to the drawing in the examples.

DESCRIPTION OF PREFERRED EMBODIMENTS

The Starting Polymer

The polymeric material utilized in the present process to form ultralow denier filaments is a linear polybenzimidazole. Typical polymers of this class and their preparation are more fully described in U.S. Pat. No. 2,895,948, U.S. Pat. No. Re. 26,065, and in the Journal of Polymer Science, Vol. 50, pages 511–539 (1961) which are herein incorporated by reference. The polybenzimidazoles consist essentially of recurring units of the following Formulas I and II.

Formula I is:

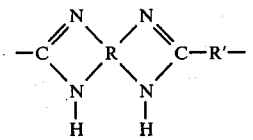

wherein R is a tetravalent aromatic nucleus, preferably symmetrically substituted, with the nitrogen atoms forming the benzimidazole rings being paired upon adjacent carbon atoms, i.e., ortho carbon atoms, of the aromatic nucleus, and R′ is a member of the class consisting of (1 ) an aromatic ring, (2) an alkylene group (preferably those having 4 to 8 carbon atoms), and (3) a heterocyclic ring from the class consisting of (a) pyridine, (b) pyrazine, (c) furan, (d) quinoline, (e) thiophene, and (f) pyran.

Formula II is:

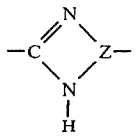

wherein Z is an aromatic nucleus having the nitrogen atoms forming the benzimidazole ring paired upon adjacent carbon atoms of the aromatic nucleus.

Preferably, aromatic polybenzimidazoles are selected, e.g., from polymers consisting essentially of the recurring units of Formulas I and II wherein R' is an aromatic ring or a heterocyclic ring.

As set forth in U.S. Pat. No. Re. 26,065, the aromatic polybenzimidazoles having the recurring units of Formula II may be prepared by self-condensing a trifunctional aromatic compound containing only a single set of ortho disposed diamino substituents and an aromatic, preferably phenyl, carboxylate ester substituent. Exemplary of polymers of this type is poly-2,5(6)-benzimidazole prepared by the autocondensation of phenyl-3,4-diaminobenzoate.

As also set forth in the above-mentioned patent, the aromatic polybenzimidazoles having the recurring units of Formula I may be prepared by condensing an aromatic tetraamine compound containing a pair of orthodiamino substituents on the aromatic nucleus with a dicarboxyl compound selected from the class consisting of (a) the diphenyl ester of an aromatic dicarboxylic acid, (b) the diphenyl ester of a heterocylic dicarboxylic acid wherein the carboxyl groups are substituents upon carbon in a ring compound selected from the class consisting of pyridine, pyrazine, furan, quinoline, thiophene, and pyran and (c) an anhydride of an aromatic dicarboxylic acid.

Examples of polybenzimidazoles which have the recurring structure of Formula I are as follows:

poly-2,2'-(m-phenylene)-5,5'-bibenzimidazole;
poly-2,2'-(pyridylene-3'',5'')-5,5'-bibenzimidazole;
poly-2,2'-(furylene-2'',5'')-5,5'-bibenzimidazole;
poly-2,2'-(naphthalene-1'',6'')-5,5'-bibenzimidazole;
poly-2,2'-(biphenylene-4''4''')-5,5'-bibenzimidazole;
poly-2,2'-amylene-5,5'-bibenzimidazole;
poly-2,2'-octamethylene-5,5'-bibenzimidazole;
poly-2,6-(m-phenylene)-diimidazobenzene;
poly-2,2'-cyclohexenyl-5,5'-bibenzimidazole;
poly-2,2'-(m-phenylene)-5,5'-di(benzimidazole)ether;
poly-2,2'-(m-phenylene)-5,5'-di(benzimidazole)sulfide;
poly-2,2'-(m-phenylene)-5,5'-di(benzimidazole)sulfone;
poly-2,2'-(m-phenylene)-5,5'-di(benzimidazole)methane;
poly-2',2''-(m-phenylene)-5',5''-di(benzimidazole)propane-2,2; and
poly-2,2'-(m-phenylene)-5',5''-di(benzimidazole)ethylene-1,2 where the double bonds of the ethylene groups are intact in the final polymer.

The preferred polybenzimidazole for use in the present process is one prepared from poly-2,2'-(m-phenylene)-5,5'-bibenzimidazole, the recurring unit of which is:

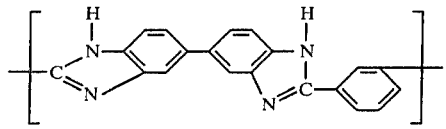

Any polymerization process known to those skilled in the art may be employed to prepare the polybenzimidazole which is utilized to form ultralow filaments in accordance with the present invention. Representative techniques for preparing the polybenzimidazole are disclosed in U.S. Pat. Nos. 3,509,108; 3,549,603; and 3,551,389, which are assigned to the assignee of the present invention and are herein incorporated by reference.

With respect to aromatic polybenzimidazoles, preferably, equimolar quantities of the monomeric tetraamine and dicarboxyl compound may be introduced into a first stage melt polymerization reaction zone and heated therein at a temperature above about 200° C., preferably at least 250° C., and more preferably from about 270° to 300° C. The reaction is conducted in a substantially oxygen-free atmosphere, i.e., below about 20 p.p.m. oxygen, until a foamed prepolymer is formed. Usually, the first stage reaction is continued until a prepolymer is formed having an inherent viscosity, expressed as deciliters per gram, of at least 0.1, and preferably from about 0.13 to 0.3 (determined from a solution of 0.4 grams of the polymer in 100 ml. of 97 percent $H_2SO_4$ at 25° C.).

After the conclusion of the first stage reaction, which normally takes at least 0.5 hour, and preferably 1 to 3 hours, the formed prepolymer is cooled and then powdered or pulverized in any convenient manner. The resulting prepolymer powder is then introduced into a second stage polymerization reaction zone wherein it is heated under substantially oxygen-free conditions, as described above, to yield a polybenzimidazole polymer product, desirably having an I.V., as measured above, of at least 0.4, e.g., 0.8 to 1.1 or more.

The temperature employed in the second stage is at least 250° C., preferably at least 325° C., and more preferably from about 350° to 425° C. The second stage reaction generally takes at least 0.5 hour, and preferably from about 1 to 4 hours or more.

The Polymer Solution

Polybenzimidazole is soluble in acids and highly polar solvents. Typical solvents, any of which may be used to form the spinning solution, include dimethylacetamide, dimethylformamide, dimethylsulfoxide, and concentrated sulfuric acid. The preferred solvent is dimethylacetamide. The polybenzimidazole polymer is provided in the spinning solution in a concentration of about 10 to 30 percent by weight based upon the weight of the total solution, and preferably in a concentration of 22 to 26 percent by weight based upon the weight of the total solution.

The spinning solution preferably also contains lithium chloride in a concentration of about 0.1 to 5 percent by weight, and most preferably in a concentration of about 1 to 4 percent by weight. The lithium chloride serves the function of preventing the polybenzimidazole polymer from phasing out of the solution upon standing for extended periods of time.

A preferred spinning solution comprises about 22 to 26 percent by weight polybenzimidazole polymer, about 1 to 4 percent lithium chloride, and about 70 to 77 percent by weight dimethylacetamide. A particularly preferred spinning solution comprises approximately 23 percent by weight polybenzimidazole polymer, approximately 2 percent by weight lithium chloride, and approximately 75 percent by weight dimethylacetamide.

The spinning solution preferably exhibits a viscosity of about 40 to 4000 poises measured at 30° C., and most preferably a viscosity of about 1200 to 2500 poises measured at 30° C.

One suitable means for dissolving the polymer in the solvent is by mixing the materials at a temperature above the normal boiling point of the solvent for example, about 25° to 120° C. above such boiling point, and at a pressure of 2 to 15 atmospheres for a period of 1 to 5 hours. The resulting solutions then preferably are filtered to remove any undissolved polymer.

Formation of Ultralow Denier Polybenzimidazole Yarn

The polybenimidazole polymer is preferably provided at a temperature of approximately 130° to 150° C. at the time of extrusion. The solution is extruded through a plurality of extrusion orifices (e.g., anywhere from five or ten to several hundred). These extrusion orifices are generally in the form of a spinneret having five or ten holes. The orifices of the present invention have a diameter of approximately 20 to 200 microns, preferably of approximately 30 to 50 microns, and most preferably of approximately 40 microns.

The spinning solution is placed in a pressure vessel, or bomb, and heated to approximately 120° C. To spin, the solution is fed under 15 p.s.i. nitrogen pressure to a metering pump driven by a variable speed D.C. motor. The pump speed, and hence the solution flow rate, is maintained constant by an electronic controller. In order to remove the last traces of particulate matter, the solution is passed through a heated candle filter and finally, just before entering the spinneret, through a stainless steel sintered disc filter. The face of the spinneret is heated to approximately 130° to 150° C. during extrusion.

The polymer solution is extruded vertically downward into a gaseous atmosphere. The gaseous atmosphere may be composed of any dry, inert gas. Such gases include nitrogen, the noble gases, steam, combustion gases, and air. Air is the preferred gas for the gaseous atmosphere.

The extruded solution is permitted to drop freely for a short distance prior to being passed through a liquid coagulation bath. In this way, a certain amount of drawing occurs and some coagulation is initiated before the polymer meets the coagulation bath. This initial coagulation of polymer in the gaseous atmosphere is ordinarily accomplished through evaporation of a portion of the solvent and/or reduced polymer solubility resulting from the reduction in temperature of the extruded solution. Commonly, approximately 5 to 10 percent of the solvent is lost in the gaseous atmosphere through evaporation.

The distance between the face of the spinneret and the coagulation bath, known as the air gap, is known to influence the quality of filaments spun by the dry jet/wet spinning process. Air gaps suitable for use in the present invention range from approximately one-half inch to 10 inches, and preferably from approximately 5 to 7 inches. The most preferred air gap is approximately 7 inches.

After dropping through the air gap, the filaments are passed through a liquid coagulation bath, comprising a non-solvent for polybenzimidazole. This bath preferably consists of water, but may also be a mixture of approximately 50 percent water and 50 percent dimethylacetamide. Little or no obvious differences in yarn properties are shown by water over the mixture of water and dimethylacetamide. Other coagulants, such as dilute dimethylacetamide and dilute sulfuric acid are also feasible. Generally, if a mixture of water and one of the above-mentioned liquids is employed as the coagulant, the liquid used corresponds to the solvent used in forming the spinning solution.

A slight flow of the coagulant is continuously fed into the coagulation bath to prevent a build-up as the spinning progresses of solvent which has been removed from the extruded filaments. The bath composition and bath temperature generally are related to the coagulation rate. It is preferred that the polymer coagulate at such a rate as to minimize inhomogeneities from the outer surface to the inner core. Although a wide range of bath temperatures may be employed, an examination of various bath temperatures indicated that cool temperatures are preferable. Therefore, the bath is preferably maintained at approximately normal room temperature for flowing liquid (i.e., approx. 15° to 25° C.). While being passed through the bath, the coagulated filaments continue to undergo the drawing which was begun in the air gap.

The term "draw ratio", as is well known, is a measure of the degree of stretching during the orientation of the fibrous material. In the present invention, the initial draw ratio is a measure of the degree of stretching of the filaments which occurs between the extrusion orifices and the exit from the coagulation bath. The initial draw ratio is defined as exit velocity divided by jet speed.

The exit velocity is the speed at which the filaments leave the coagulation bath. Although any means of measurement may be used, the exit velocity is conveniently determined by the surface speed of the rolls which take up the filaments after their exit from the bath. Thus, the speed of the wash rolls is preferably measured for this purpose.

The jet speed is the speed at which the extruded polymer exits an extrusion orifice. It is conveniently determined by dividing the total polymer extrusion velocity by the total surface area of the extrusion orifices.

In the present invention, the initial draw ratio is approximately 2:1 to 50:1. Preferably, the initial draw ratio is approximately 2:1 to 10:1, and, most preferably, approximately 3:1 to 3.5:1.

The coagulated fibers leaving the coagulation bath are passed to a washing zone. The continuous length of polybenzimidazole fibrous material is washed so as to remove at least the major portion of residual spinning solvent. The washed materials contain less than about 1 percent by weight solvent based on the weight of the continuous filamentary material, and preferably so as to obtain an essentially solvent-free fibrous material (i.e., a fibrous material containing less than about 0.1 percent solvent by weight). Typically, a simple water wash is employed; however, if desired, other wash materials such as acetone, methanol, methylethyl ketone and similar solvent-miscible and volatile organic solvents may be used in place of or in combination with the water. The preferred washing zone of the present invention comprises a set of skewed rolls, the bottom one of which is partially immersed in the wash liquid. Although a wide range of temperatures may be employed, the wash liquid is preferably provided at a temperature of approximately 55° to 65° C. By wrapping the filaments several times around the skewed rolls, the filaments remain for some time on the rolls, during which it is washed free of solvent.

The polybenzimidazole filaments from the first set of skewed rolls (wash rolls) are passed to a drying zone. Although any appropriate apparatus may be used, the filaments are preferably dried by passing them over a set of steam-heated (e.g., to approximately 100° C.) skewed rolls. Again, the number of wraps given the filaments determines the length of time on the rolls. Sufficient time is provided to assure that the filaments are thoroughly dried before they are subjected to the high temperature drawing step of the process.

The manner in which heat is applied to the polybenzimidazole fiber undergoing hot drawing may be varied widely. For instance, the fiber may be heated via radiation heating by passage through a muffle furnace or other hot gas heating zone. Alternatively, the polybenzimidazole fiber undergoing hot drawing may be heated via conductive heating wherein the fiber is passed over a hot surface, such as one or more hot shoes, rolls, plates, pins, etc.

Heat-drawing of the filament is preferably accomplished by passing the dried filaments through a heated muffle furnace at approximately 400° to 500° C. Skewed rolls before and after the muffle furnace are accurately maintained at different speeds such that the filaments are under a given degree of tension. The combination of the spin line tension and the muffle furnace temperature causes the filaments to elongate. In so doing, the polymeric structure within the filaments becomes somewhat better organized and the physical properties are developed. The tension on the filaments is maintained so that the heat draw ratio is approximately 1.5:1 to 10:1. A heat draw ratio of approximately 3:1 to 6:1 is preferred, and a heat draw ratio of approximately 3:1 to 3.5:1 is most preferred.

The heat draw ratio is a measure of the degree of stretching of the filaments which occurs in the heat drawing zone. While any of the several known ways for measuring or determining draw ratio may be employed, typically the draw ratio is found by taking the ratio of the surface speed of a take-up roll at the exit end of the drawing zone to the surface speed of a feed or supply roll at the entrance end of the drawing zone. Preferably, the heat draw ratio is determined by the relative speeds of the set of exit rolls and the set of drying rolls, which serve as feed rolls to the drawing zone.

The drawn filaments are collected by any conventional means. A preferred apparatus is assembled from a D.C. motor, the speed of which can be precisely controlled, and a transverse winder. This set-up provides less tension during take-up and permits longer continuous operation without breaking the filaments than do commercial units.

The physical properties of the ultralow denier filaments produced by the inventive process were measured by standard ASTM test methods. The filaments have a denier per filament of approximately 0.05 to 0.50. The preferred denier per filament is 0.10 to 0.30, and a denier per filament of 0.15 to 0.20 is most preferred. The filaments have a tenacity of at least 4 grams per denier. The physical properties preferably range from 5 to 7.5 grams per denier tenacity, 5 to 20 percent elongation, and 130 to 175 grams per denier modulus. These properties are roughly comparable to those obtained with 1.5 denier per filament polybenzimidazole fibers. By means of the present invention, an order-of-magnitude reduction in denier was achieved with little sacrifice of fiber physical properties.

Because of the inherent resistance of polybenzimidazole to combustion, chemicals, and radiation, as well as its low, relatively non-toxic smoke generation, ultralow denier polybenzimidazole yarns are useful for weight-critical applications in hostile or hazardous environments. Such applications may include insulating pads or mats and other high-strength, light-weight, non-flammable articles. In such articles, ultralow denier polybenzimidazole filaments may be used as a replacement for mineral fibers, such as fiberglass.

Other applications may include the use of ultralow denier polybenzimidazole filaments as one component in artificial organs (e.g., hearts).

The polybenzimidazole filaments formed by the process of the present invention may also be used in a variety of textile products which require an ultralow denier filament having high-strength characteristics.

The following examples are given as specific illustrations of the invention. It should be understood, however, that the invention is not limited to the specific details set forth in the examples. Reference is made in the examples to the drawing.

EXAMPLE I

A polybenzimidazole spinning solution was prepared employing dimethylacetamide solvent. The spinning solution contained 23 percent by weight poly-2,2′-(m-phenylene)-5,5′-bibenzimidazole, 2 percent by weight lithium chloride (added as a stabilizer), and 75 percent by weight dimethylacetamide. The dissolution of the polymer was accomplished by agitating the same while in particulate form with the dimethylacetamide solvent (in which the lithium chloride was previously dissolved) while in a closed vessel at a temperature of approximately 230° C.

The spinning solution was provided in spinning bomb 1 and heated to 120° C. The spinning solution was fed via line 2 under 15 p.s.i. nitrogen pressure to a metering pump 4 driven by a variable D.C. motor. The spinning solution was passed via line 6 to a heated candle filter 8 and via line 10 to a stainless steel sintered disc filter 12. The spinning solution was extruded vertically downward through a spinneret 14 which was heated to 130° C. The spinneret had 5 holes, each of which had a diameter of 40 microns. The extruded polymer 15 was passed through a seven-inch air gap and into a water coagulation bath 16.

The coagulation bath 16 was provided in vessel 18 having a length of one meter. The coagulation bath 16 was maintained at approximately 15° to 25° C., and a slight flow of fresh water was continuously fed into the coagulation bath 16 in order to prevent a build-up of solvent as spinning progressed. Guide rolls 20 and 22 were provided below the surface of the coagulation bath 16.

The coagulated fibers leaving the coagulation bath 16, after undergoing a initial draw ratio of 3.1:1, were passed around a pair of skewed rolls 24 and 25. The bottom roll 25 was partially immersed in a bath 26 of continuously running hot water (e.g., at a temperature of approximately 55° to 65° C.), provided in vessel 28.

The fibers were wrapped around rolls 24 and 25 several times in order to wash the fibers free of solvent.

The fibers from the first set of skewed rolls (wash rolls) were dried by passing them over a set of steam-heated skewed rolls (30 and 32). Several wraps were given on the heated rolls 30 and 32 in order to provide sufficient time for the filaments to dry thoroughly.

The dried fibers were then heat drawn by being passed through a heated muffle furnace 34 at 500° C. The heat draw ratio was 3:1. The fibers were then collected on a bobbin (shown as take-up unit 40) after passing over a set of exit rolls 36 and 38.

The resulting filaments had a denier per filament of 0.17 and the following physical properties:

| | |
|---|---|
| Tenacity (grams per denier) | 6.94 |
| Elongation (percent) | 9.52 |
| Modulus (grams per denier) | 167 |

EXAMPLE II

The polymer solution of Example I was spun into fibers and the fibers were coagulated, washed, dried, and heat drawn according to the procedure of Example I, except that the initial draw ratio was 3.3:1 and the heat draw ratio was 3.1:1. The resulting fibers had a denier per filament of 0.18 and the following physical properties:

| | |
|---|---|
| Tenacity (grams per denier) | 7.5 |
| Elongation (percent) | 12.9 |
| Modulus (grams per denier) | 167 |

EXAMPLE III

The polymer solution was prepared and the resulting fibers were spun according to the procedure of Example I, except that the spinneret had 10 holes, each of which was 40 microns in diameter. The initial draw ratio was 1.9:1, and the heat draw ratio was 4.6:1. The resulting fibers had a denier per filament of 0.36 and the following physical properties:

| | |
|---|---|
| Tenacity (grams per denier) | 6.6 |
| Elongation (percent) | 16.6 |
| Modulus (grams per denier) | 130 |

Although the invention has been described with preferred embodiments, it is to be understood that variations and modifications may be employed as will be apparent to those skilled in the art. Such variations and modifications are to be considered within the purview and scope of the claims appended hereto.

I claim:

1. A process for the stable production of high strength polybenzimidazole filaments of ultralow denier comprising:

(a) providing a spinning solution comprising approximately 10 to 30 percent by weight of a polybenzimidazole in a solvent selected from the group consisting of dimethylacetamide, dimethylformamide, dimethylsulfoxide, and concentrated sulfuric acid, (b) extruding said spinning solution vertically downward into a gaseous atmosphere following passage through a plurality of extrusion orifices having a diameter of approximately 20 to 200 microns to form a plurality of filaments with the concomitant drawing of said filaments, (c) passing said resulting filaments from said gaseous atmosphere to a bath comprising a non-solvent for said polybenzimidazole, (d) passing said filaments through said bath wherein (i) coagulation of said polybenzimidazole is accomplished, and (ii) the drawing of said filaments is continued, with an initial draw ratio of approximately 2:1 to 50:1 being achieved, (e) passing said filaments from said bath to a washing zone, (f) washing said resulting filaments while passing through said washing zone to substantially remove residual solvent, (g) passing said filaments from said washing zone to a drying zone, (h) drying said filaments while passing through said drying zone, (i) passing said filaments from said drying zone to a drawing zone provided at a temperature of approximately 400° to 500° C., (j) drawing said filaments while passing through said drawing zone at a heat draw ratio of approximately 1.5:1 to 10:1 to produce polybenzimidazole filaments having a denier per filament of approximately 0.05 to 0.5 and a tenacity of at least 4 grams per denier, and (k) collecting said ultraflow denier filaments following withdrawal from said drawing zone.

2. A process according to claim 1 wherein said polybenzimidazole polymer consists essentially of recurring units of the formula

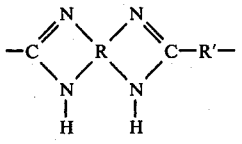

wherein R is a tetravalent aromatic nucleus, with the nitrogen atoms forming the benzimidazole rings paired upon adjacent carbon atoms of said aromatic nucleus, and R' is selected from the group consisting of (1) an aromatic ring, (2) an alkylene group having from 4 to 8 carbon atoms, and (3) a heterocyclic ring selected from the group consisting of (a) pyridine, (b) pyrazine, (c) furan, (d) quinoline, (e) thiophene, and (f) pyran.

3. A process according to claim 1 wherein said polybenzimidazole polymer is poly-2,2'-(m-phenylene)-5,5'-bibenzimidazole.

4. A process according to claim 1 wherein said solution of said polybenzimidazole prior to extrusion includes approximately 0.1 to 5 percent lithium chloride, based upon the total weight of said solution.

5. A process according to claim 1 wherein the solvent for said solution comprises dimethylacetamide.

6. A process according to claim 1 wherein said extrusion orifices are situated approximately one-half inch to 10 inches above said coagulation bath.

7. A process according to claim 1 wherein said solution is extruded at a temperature of approximately 130° to 150° C.

8. A process according to claim 1 wherein said extrusion orifices have a diameter of approximately 30 to 50 microns.

9. A process according to claim 1 wherein said gaseous atmosphere comprises an inert gas selected from the group consisting of nitrogen, the noble gases, steam, combustion gases, and air.

10. A process according to claim 1 wherein said gaseous atmosphere comprises air.

11. A process according to claim 1 wherein said liquid coagulation bath comprises water.

12. A process according to claim 1 wherein said liquid coagulation bath comprises a mixture of approximately 50 percent water and approximately 50 percent dimethylacetamide.

13. A process according to claim 1 wherein said liquid coagulation bath is maintained at a temperature of approximately 15° to 25° C.

14. A process according to claim 1 wherein said initial draw ratio is approximately 2:1 to 10:1.

15. A process according to claim 1 wherein said filaments are washed with water at a temperature of approximately 55° to 65° C.

16. A process according to claim 1 wherein said heat draw ratio is approximately 3:1 to 6:1.

17. A process for the stable production of high strength polybenzimidazole filaments of ultralow denier comprising:

(a) providing a spinning solution comprising approximately 22 to 26 percent by weight of a polybenzimidazole, approximately 1 to 4 percent by weight of lithium chloride, and approximately 70 to 77 percent by weight of dimethylacetamide, (b) extruding said spinning solution vertically downward into a gaseous atmosphere comprising air following passage through a plurality of extrusion orifices having a diameter of approximately 30 to 50 microns to form a plurality of filaments with the concomitant drawing of said filaments, (c) passing said resulting filaments from said gaseous atmosphere to a bath comprising water, (d) passing said filaments through said bath wherein (i) coagulation of said polybenzimidazole is accomplished, and (ii) the drawing of said filaments is continued, with an initial draw ratio of approximately 2:1 to 10:1 being achieved, (e) passing said filaments from said bath to a washing zone, (f) washing said resulting filaments with water while passing through said washing zone to substantially remove residual solvent, (g) passing said filaments from said washing zone to a drying zone, (h) drying said filaments while passing through said drying zone, (i) passing said filaments from said drying zone to a drawing zone provided at a temperature of approximately 400° to 500° C., (j) drawing said filaments while passing through said drawing zone at a heat draw ratio of approximately 3:1 to 6:1 to produce polybenzimidazole filaments having a denier per filament of approximately 0.05 to 0.5 and a tenacity of at least 4 grams per denier, and (k) collecting said ultralow denier filaments following withdrawal from said drawing zone.

18. A process according to claim 17 wherein said polybenzimidazole polymer consists essentially of recurring units of the formula:

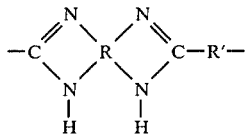

wherein R is a tetravalent aromatic nucleus, with the nitrogen atoms forming the benzimidazole rings paired upon adjacent carbon atoms of said aromatic nucleus, and R′ is selected from the group consisting of (1) an aromatic ring, (2) an alkylene group having from 4 to 8 carbon atoms, and (3) a heterocyclic ring selected from the group consisting of (a) pyridine, (b) pyrazine, (c) furan, (d) quinoline, (e) thiophene, and (f) pyran.

19. A process according to claim 17 wherein said polybenzimidazole polymer is poly-2,2′-(m-phenylene)-5,5′-bibenzimidazole.

20. A process according to claim 17 wherein said solution is extruded at a temperature of approximately 130° to 150° C.

21. A process according to claim 17 wherein said extrusion orifices are situated approximately 5 to 7 inches above said bath.

22. A process according to claim 17 wherein said coagulation bath is maintained at a temperature of approximately 15° to 25° C.

23. A process according to claim 17 wherein said initial draw ratio is approximately 3:1 to 3.5:1.

24. A process according to claim 17 wherein said filaments are washed with water at approximately 55° to 65° C.

25. A process according to claim 17 wherein said heat draw ratio is approximately 3:1 to 3.5:1.

26. A process for the stable production of high strength polybenzimidazole filaments of ultralow denier comprising:

(a) providing a spinning solution comprising approximately 23 percent by weight poly-2,2′-(m-phenylene)-5,5′-bibenzimidazole, approximately 2 percent by weight lithium chloride, and approximately 75 percent by weight dimethylacetamide, (b) extruding said spinning solution vertically downward into a gaseous atmosphere comprising air following passage through a plurality of extrusion orifices having a diameter of approximately 30 to 50 microns to form a plurality of filaments with the concomitant drawing of said filaments, (c) passing said resulting filaments from said gaseous atmosphere to a bath comprising water, (d) passing said filaments through said bath wherein (i) coagulation of the polybenzimidazole is accomplished and (ii) the drawing of said filaments is continued, with an initial draw ratio of 3:1 to 3.5:1 being achieved, (e) passing said filaments from said bath to a washing zone, (f) washing said resulting filaments with water at approximately 55° to 65° C. while passing through said washing zone to substantially remove residual solvent, (g) passing said filaments from said washing zone to a drying zone, (h) drying said filaments while passing through said drying zone, (i) passing said filaments from said drying zone to a drawing zone provided at a temperature of approximately 400° C. to 500° C., (j) drawing said filaments while passing through said drawing zone at a heat draw ratio of approximately 3:1 to 3.5:1 to produce polybenzimidazole filaments having a denier per filament of approximately 0.05 to 0.5 and a tenacity of at least 4 grams per denier, and (k) collecting said ultralow denier filaments following withdrawal from said drawing zone.

27. A process according to claim 26 wherein said solution is extruded at a temperature of approximately 130° to 150° C.

28. A process according to claim 26 wherein said extrusion orifices have a diameter of approximately 40 microns.

29. A process according to claim 26 wherein said extrusion orifices are situated approximately 7 inches above said bath.

30. A process according to claim 26 wherein said coagulation bath is maintained at a temperature of approximately 15° to 25° C.

* * * * *